US006500354B1

(12) United States Patent
Lee et al.

(10) Patent No.: US 6,500,354 B1
(45) Date of Patent: Dec. 31, 2002

(54) INKJET PRINTER HEAD ACTUATOR AND METHOD FOR MANUFACTURING THE SAME

(75) Inventors: Seung Don Lee, Sungnam (KR); Jae Woo Joung, Inchon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 134 days.

(21) Appl. No.: 09/625,005

(22) Filed: Jul. 25, 2000

Related U.S. Application Data

(62) Division of application No. 09/336,663, filed on Jun. 18, 1999, now abandoned.

(30) Foreign Application Priority Data

Dec. 30, 1998 (KR) ..... 98-60617

(51) Int. Cl.[7] ..... B41J 2/045

(52) U.S. Cl. ..... 216/27; 216/49; 216/95; 216/100; 347/68; 347/70; 347/71; 347/72

(58) Field of Search ..... 216/27, 49, 95, 216/100; 347/68, 70, 71, 72

(56) References Cited

U.S. PATENT DOCUMENTS 4,380,018 A * 4/1983 Andoh et al. ..... 346/47
4,730,197 A * 3/1988 Raman et al. ..... 347/10
5,790,156 A * 8/1998 Mutton et al. ..... 310/331
5,933,167 A * 8/1999 Shimada et al. ..... 347/70
6,079,820 A * 6/2000 Dijksman et al. ..... 347/68
6,086,188 A * 7/2000 Ishida et al. ..... 347/70
6,254,223 B1 * 7/2001 Kim et al. ..... 347/70
6,256,849 B1 * 7/2001 Kim, II ..... 216/27
6,280,643 B1 * 8/2001 Silverbrook ..... 216/27
6,299,295 B1 * 10/2001 Miura et al. ..... 347/68

FOREIGN PATENT DOCUMENTS

JP 08-252914 * 10/1996 ..... B41J/2/045

* cited by examiner

*Primary Examiner*—Randy Gulakowski
*Assistant Examiner*—J Smetana
(74) *Attorney, Agent, or Firm*—Darby & Darby

(57) ABSTRACT

An inkjet printer head actuator including a vibrating plate having a flat plate shape, a chamber plate coupled to the vibrating plate, the chamber plate having chamber walls defining a plurality of uniformly spaced chambers each having a horizontal cross-sectional area decreasing gradually, as it extends one end thereof arranged toward the vibrating plate to the other end thereof arranged away from the vibrating plate, each of the chamber walls having a horizontal cross-sectional area increasing gradually as it extends one end thereof arranged toward the vibrating plate to the other end thereof arranged away from the vibrating plate, and a plurality of drive means attached to a surface of the vibrating plate opposite to the chamber plate at regions corresponding to the chambers, respectively. In this structure, the resistance moment caused by the bonding force of the chamber plate at the chamber wall end arranged away from the vibrating plate is greater than the total moment generated by each of the drive means.

16 Claims, 9 Drawing Sheets

INKJET PRINTER HEAD ACTUATOR AND METHOD FOR MANUFACTURING THE SAME

This patent application is a divisional of U.S. patent application Ser. No. 09/336,663, filed Jun. 18, 1999, now abandoned.

BACKGROUND OF THE INVENTION

1. Field of the Invention

The present invention relates to an inkjet printer head actuator in which a chamber plate has chamber walls defining ink chambers and having a cross-sectional area at its portion coupled to a vibrating plate, larger than the cross-sectional area at its portion opposite to the vibrating plate, thereby achieving an increase in the bonding strength of the chamber plate resulting in an improvement in the performance and ink jetting efficiency of the printer head. The present invention also relates to a method for fabricating such an inkjet printer head actuator.

2. Description of the Prior Art

As well known, an inkjet printer head is a part of an inkjet printer for jetting or firing ink in the form of droplets using an actuator such as a piezoelectric element.

Generally, drop-on-demand (DOD) type printer heads are most widely used for inkjet printers. Such DOD type printer heads are configured to jet or fire droplets of a recording solution onto paper under atmospheric pressure on demand. Use of such DOD type printer heads has increased in that they require no electric charge or deflection of droplets of a recording solution and in that easy printing is achieved, as compared to printer heads of earlier types.

Typical jetting systems of such DOD type printer heads include a heating type jetting system using a resistor and a vibration type jetting system using a piezoelectric element.

The heating type jetting system is also known as a thermal bubble jet type jetting system. Referring to FIG. 1, a typical configuration of such a heating type jetting system is illustrated. As shown in FIG. 1, this heating type jetting system includes a chamber a1 for containing a recording solution therein, and a nozzle a2 provided at the top portion of the chamber al in such a fashion that it is open to a recording sheet (for example, paper). Opposite to the nozzle a2, a resistor a3 is provided at the bottom portion of the chamber a1.

When voltage of a certain level from a voltage source not shown is applied to the resistor a3, the recording solution contained in the chamber a1 is vaporized while being heated by the resistor a3, thereby creating a bubble. Expansion of this bubble creates a pressure forcing a certain amount of the recording solution to be pushed out from the chamber a1 through the nozzle a2. Thus, jetting of the recording solution onto the recording sheet is achieved.

However, such a heating type jetting system involves a problem in that the chemical ingredients of the recording solution itself may vary due to the heat generated from the resistor a3. Such a chemical variation may result in a plugging-up of the nozzle a2. Furthermore, there is a drawback in that the resistor a3 is reduced in its use life span due to repetitive voltage application thereto.

On the other hand, the vibration type jetting system is also known as a piezo transducer type jetting system. Referring to FIG. 2, a typical configuration of such a vibration type jetting system is illustrated. As shown in FIG. 2, this vibration type jetting system includes a chamber b1 for containing a recording solution therein, a nozzle b2 provided at the top portion of the chamber b1 in such a fashion that it is open to a recording sheet (for example, paper), and a piezoelectric element b3 provided at the bottom portion of the chamber b1 opposite to the nozzle b2.

The vibration type jetting system is different from the heating type jetting system in that a recording solution is jetted using the piezoelectric element b3 having a compact structure, in place of the resistor a3 used in the heating type jetting system.

When voltage of a certain level is applied to the piezoelectric element b3, a deformation in the piezoelectric element b3 occurs, thereby resulting in an instantaneous volume variation in the chamber b1. As a result, the recording solution is forced out of the chamber b1 through the nozzle b2. Thus, the recording solution is jetted onto the recording sheet.

Recently, such a vibration type jetting system using a piezoelectric element has been widely used because it can prevent a chemical variation of the recording solution, thereby achieving a more stable jetting of the recording solution, as compared to the heating type jetting system.

Referring to FIG. 3, a conventional inkjet printer head is illustrated which is configured to use the above mentioned vibration type jetting system. In FIG. 3, the reference numeral 1 denotes a nozzle plate formed with nozzles for jetting droplets of ink. The reference numeral 2 is a channel plate 2 formed over the nozzle plate 1.

A chamber plate 3 is layered over the channel plate 2. The chamber plate 3 has vertical through holes open at both ends thereof and adapted to define chambers 3*a*. A vibrating plate 4 is layered over the chamber plate 3 to cover the chambers 3*a*. Piezoelectric elements 5 are attached to the upper surface of the vibrating plate 4 at regions corresponding to the chambers 3*a*, respectively.

Generally, the formation of the chamber plate 3 is achieved by forming a green sheet using a ceramic material in accordance with a screen printing process, forming chambers 3*a* at the green sheet in accordance with a punching process, and then sintering the punched green sheet.

In the chamber plate 3 fabricated in the above mentioned manner, there are a plurality of uniformly spaced chambers 3*a* arranged in a matrix array. These chambers 3*a* have substantially vertical side walls.

Each of the chambers 3*a* is closed at the bottom thereof by the channel plate 2 and at the top thereof by the vibrating plate 4. The piezoelectric elements 5 attached to the vibrating plate 4 are arranged at regions corresponding to the chambers 3*a*, respectively.

In the above mentioned structure, each chamber 3*a* has the same cross-sectional area at the bottom and top thereof. In other words, each side wall of each chamber 3*a* has the same thickness at its upper and lower ends. Due to such a structure, the vibrating plate 4 exhibits an insufficient bending strain when the piezoelectric elements 5 are strained. As a result, an insufficient ink jetting force is generated. For this reason, the above mentioned structure has a drawback in that it is impossible to achieve a high printing efficiency.

Referring to FIG. 4, another conventional inkjet printer head is illustrated which is configured to use the above mentioned vibration type jetting system. This printer head includes a nozzle plate 10, and a channel plate 20 layered over the nozzle plate 10, as in the case of FIG. 3. A chamber plate 30 having chambers 31 is formed over the channel plate 20 in accordance with an electro-forming process. A vibrating plate 40 is layered over the chamber plate 30 to cover the chambers 31. Piezoelectric elements 50 are attached to the upper surface of the vibrating plate 40 at regions corresponding to the chambers 31, respectively.

In this structure, each chamber 31 formed at the chamber plate 30 has a cross-sectional area increasing gradually as it extends downwardly from the top thereof to the bottom thereof. In other words, each side wall of each chamber 31 has a thickness decreasing gradually as it extends downwardly from its upper end to its lower end.

Due to such a structure, the bending strain of the vibrating plate 40 generated when the piezoelectric elements 5 are strained is smaller than that in the case of FIG. 3. This is because the cross-sectional area of the chamber 31 at the top thereof near the vibrating plate 40 is smaller than that in the case of FIG. 3. As a result, an insufficient ink jetting force is generated which is smaller than that in the case of FIG. 3.

In this structure, therefore, the printing efficiency is further degraded. Moreover, this structure has a very small bonding area between the channel plate 20 and chamber plate 30 because each chamber wall of the chamber plate 30 has a reduced thickness at its lower end bonded to the channel plate 20. Such a very small bonding area results in an insufficient bonding force of the chamber plate 30 to the channel plate 20. For this reason, the bonding of the chamber plate 30 to the channel plate 20 may be damaged as the chamber plate 30 is subjected to the repeated bending strain of the vibrating plate 40. Thus, the printer head involves a degradation in durability resulting in a reduction in use life span.

SUMMARY OF THE INVENTION

Therefore, an object of the invention is to provide an inkjet printer head actuator having a chamber plate formed with chambers each having a cross-sectional area decreasing gradually as it extends downwardly from the top thereof to the bottom thereof, so as to maximize a bending moment generated at a vibrating plate attached to the top of the chamber plate, thereby increasing the ink jetting force, so that an improvement in printing efficiency is achieved.

Another object of the invention is to provide an inkjet printer head actuator having a chamber plate provided with chamber walls defining chambers, each of the chamber walls having a cross-sectional area increasing gradually as it extends downwardly from its upper end to its lower end, so as to increase the bonding force of the chamber wall at its lower end, thereby keeping a stable operation while achieving an improvement in durability.

In accordance with the present invention, these objects are accomplished by providing an inkjet printer head actuator including: a vibrating plate having a flat plate shape; a chamber plate coupled to the vibrating plate, the chamber plate having chamber walls defining a plurality of uniformly spaced chambers each having a horizontal cross-sectional area decreasing gradually, as it extends one end thereof arranged toward the vibrating plate to the other end thereof arranged away from the vibrating plate, each of the chamber walls having a horizontal cross-sectional area increasing gradually as it extends one end thereof arranged toward the vibrating plate to the other end thereof arranged away from the vibrating plate; and a plurality of drive means attached to a surface of the vibrating plate opposite to the chamber plate at regions corresponding to the chambers, respectively. In this structure, the resistance moment caused by the bonding force of the chamber plate at the chamber wall end arranged away from the vibrating plate is greater than the total moment generated by each of the drive means.

BRIEF DESCRIPTION OF THE DRAWINGS

Other objects and aspects of the invention will become apparent from the following description of embodiments with reference to the accompanying drawings in which:

FIGS. 7 to 12 illustrate a first embodiment of the present invention associated with a method for fabricating an inkjet printer head actuator having the above mentioned structure according to the present invention, respectively, in which FIG. 7 is a cross-sectional view illustrating the step of forming a vibrating plate over a substrate, FIG. 8 is a cross-sectional view illustrating the step of coating a photoresist film over the vibrating plate of FIG. 7, FIG. 9 is a cross-sectional view illustrating the step of patterning the photoresist film of FIG. 8, FIG. 10 is a cross-sectional view illustrating the step of forming a chamber plate on the vibrating plate using the patterned photoresist film of FIG. 9 as a mask, FIG. 11 is a cross-sectional view illustrating the step of removing the photoresist film from the structure of FIG. 10, and FIG. 12 is a cross-sectional view illustrating the step of removing the substrate from the structure of FIG. 11;

FIGS. 14 to 20 illustrate a second embodiment of the present invention associated with a method for fabricating an inkjet printer head actuator having the above mentioned structure according to the present invention, respectively, in which FIG. 14 is a cross-sectional view illustrating the step of coating photoresist films over opposite surfaces of a chamber plate, FIG. 15 is a cross-sectional view illustrating the step of patterning one of the photoresist films of FIG. 14, FIG. 16 is a cross-sectional view illustrating the step of etching the chamber plate using the patterned photoresist film as a mask, FIG. 17 is a cross-sectional view illustrating the step of completely removing the photoresist films left on the chamber plate of FIG. 16, FIG. 18 is a cross-sectional view illustrating the step of coupling a vibrating plate to the chamber plate of FIG. 17, FIG. 19 is a cross-sectional view illustrating the step of depositing a vibrating plate over a substrate, and FIG. 20 is a cross-sectional view illustrating the step of coupling the vibrating plate of FIG. 19 to the chamber plate; and FIGS. 21 to 25 illustrate a third embodiment of the present invention associated with a method for fabricating an inkjet printer head actuator having the above mentioned structure according to the present invention, respectively, in which FIG. 21 is a cross-sectional view illustrating a state in which a chamber plate is inserted in a press before it is subjected to a punching process, FIG. 22 is a cross-sectional view illustrating the step of punching the chamber plate using the press, FIG. 23 is a cross-sectional view illustrating a state of the chamber plate deformed by the punching process, FIG. 24 is a cross-sectional view illustrating the step of grinding the chamber plate, and FIG. 25 is a cross-sectional view illustrating the step of coupling a vibrating plate to the chamber plate of FIG. 24.

DESCRIPTION OF THE PREFERRED EMBODIMENTS

Figure 1:
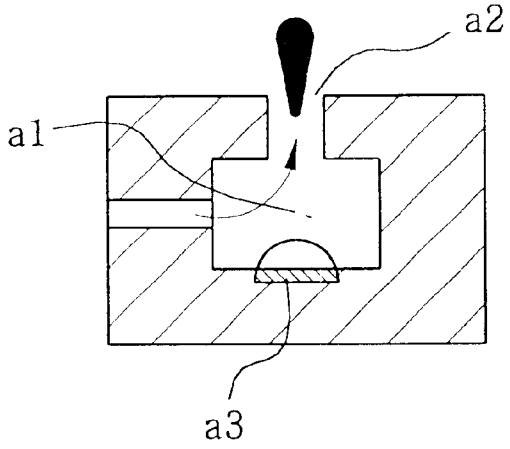
FIG.1 (PRIOR ART)
FIG. 1 is a cross-sectional view schematically illustrating a conventional ink jetting configuration using a thermal bubble jet type jetting system.
Figure 2:
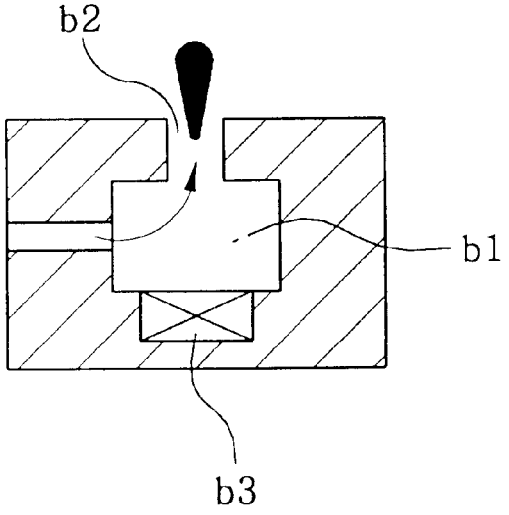
FIG.2 (PRIOR ART)
FIG. 2 is a cross-sectional view schematically illustrating another conventional ink jetting configuration using a piezo transducer type jetting system.
Figure 3:
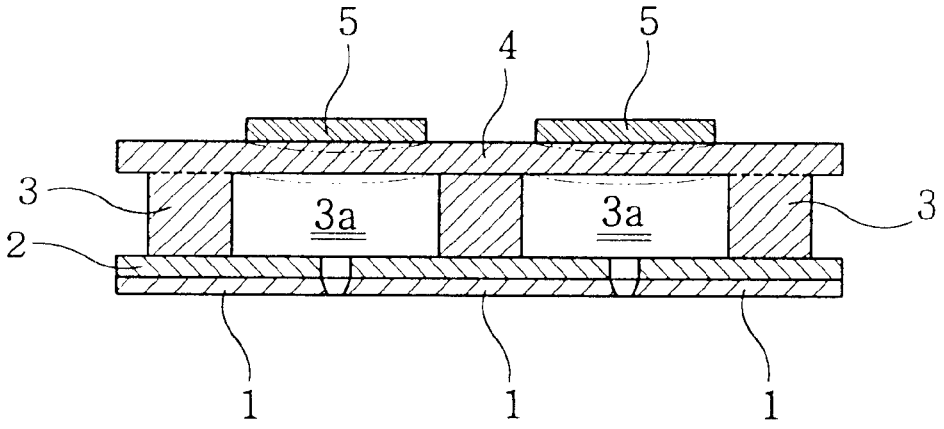
FIG.3 (CONVENTIONAL ART)
FIG. 3 is a cross-sectional view illustrating an example of an inkjet printer head using a typical vibration type jetting system.
Figure 4:
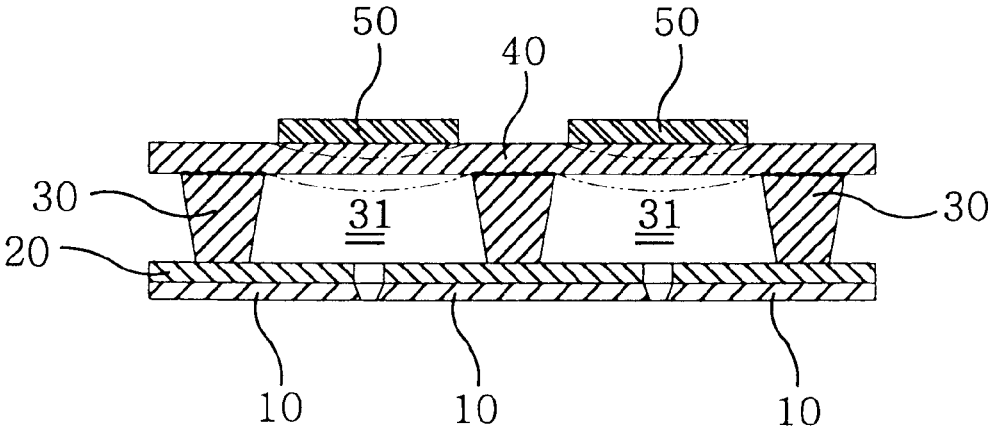
FIG.4 (CONVENTIONAL ART)
FIG. 4 is a cross-sectional view illustrating another example of an inkjet printer head using the typical vibration type jetting system.
Figure 5:
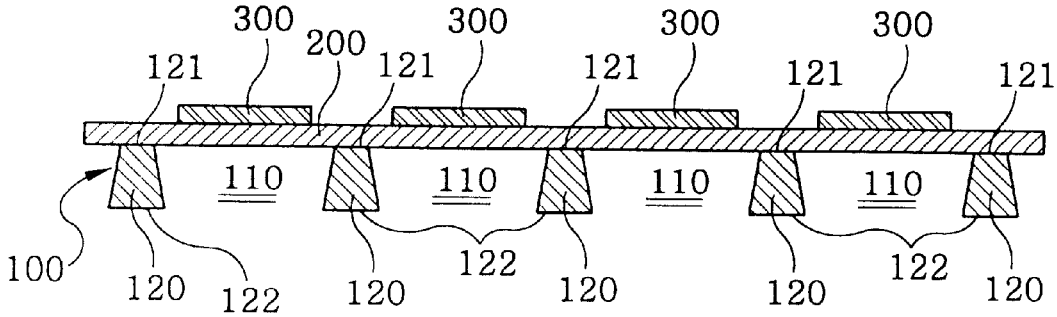
FIG. 5 is a cross-sectional view illustrating an inkjet printer head according to the present invention.

FIG. 5 is a cross-sectional view illustrating an inkjet printer head actuator having a structure according to a preferred embodiment of the present invention. In FIG. 5, the reference numeral 100 denotes a chamber plate, 200 a vibrating plate, and 300 a drive means comprising a combination of a piezoelectric element and an electrode coupled together.

The chamber plate 100 has a flat plate shape and is provided with a plurality of uniformly spaced chambers 110 each having the form of a vertical through hole open at both ends thereof. In accordance with the present invention, each of the chambers 110 is characterized in that it has a cross-sectional area decreasing gradually as it extends downwardly from the top thereof to the bottom thereof.

That is, each of chamber walls 120 disposed between adjacent chambers 110 to define those chambers 110 in the chamber plate 100 has a cross-sectional area increasing gradually as it extends downwardly from its upper end to its lower end.

A vibrating plate 200 is attached to the upper surface of the chamber plate 100, where the chambers 110 have a maximum cross-sectional area, in such a fashion that it is integral with the chamber plate 100. Accordingly, the chambers 110 are covered by the vibrating plate 200 at their top portions. A plurality of drive means 300 each comprising a piezoelectric element coupled to an electrode are deposited on the upper surface of the vibrating plate 200 at regions corresponding to the chambers 110, respectively. Thus, an inkjet printer head actuator is fabricated.

In order to fabricate the structure of FIG. 5 into an inkjet printer head, a channel plate or a channel plate means, such as a restrictor plate or reservoir plate, adapted to guide flows of ink is bonded to the lower surface of the chamber plate 100. Finally, a nozzle plate is bonded to the channel plate or channel plate means. Thus, an inkjet printer head is fabricated.

Figure 6:
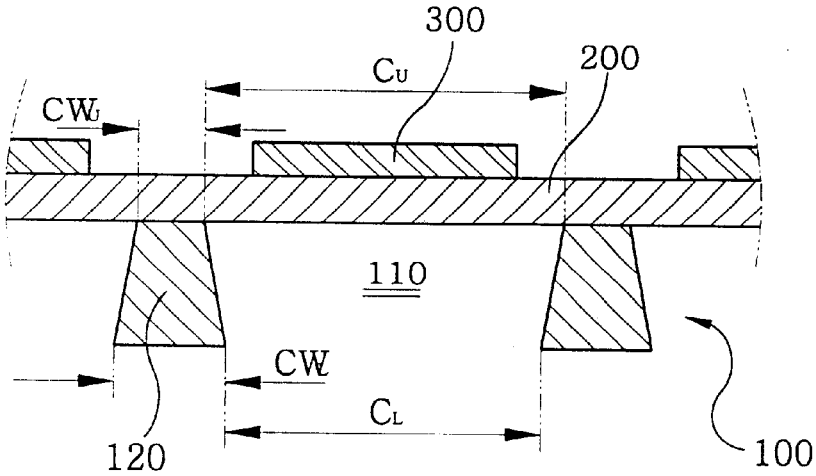
FIG. 6 is an enlarged view illustrating a portion of FIG. 5.

This embodiment of the present invention is characterized by the structure coupling the chamber plate 100, vibrating plate 200, and drive means 300. That is, the structure, in which each of the chamber walls 120 and each of the chambers 110 are offset from each other in regard to their cross-sectional areas, is characterized in that it has a shape of FIG. 6.

This will be described in more detail. Typically, the chamber plate has a structure in which each of chamber walls and each of chambers are offset from each other in regard to their cross-sectional areas. That is, each unit portion of the chamber plate consisting of one chamber and halves of opposite chamber walls respectively arranged in opposite sides of the chamber has a constant cross-sectional area corresponding to the sum of the cross-sectional area of that chamber and the cross-sectional areas of those chamber wall halves throughout the vertical thickness thereof. In other words, each chamber wall has a cross-sectional area decreasing in proportion to an increase in the cross-sectional area of the associated chamber or increasing in proportion to a decrease in the cross-sectional area of the associated chamber.

In accordance with the illustrated embodiment of the present invention, the chamber plate 100 has a structure in which each chamber 110 has a horizontal cross-sectional area decreasing gradually as it extends downwardly in such a fashion that it has a maximum horizontal cross-sectional area $C_U$ at the upper end thereof, namely, the top thereof, while having a minimum horizontal cross-sectional area $C_L$ at the lower end thereof, namely, the bottom thereof, whereas each chamber wall 120 has a horizontal cross-sectional area increasing gradually as it extends downwardly in such a fashion that it has a minimum horizontal cross-sectional area $CW_U$ at the upper end thereof while having a maximum cross-sectional area $CW_L$ at the lower end thereof.

In this case, each chamber and opposite chamber walls defining the chamber are formed in such a fashion that they are laterally symmetric with respect to a vertical center line of the chamber.

Although each chamber 110 is structured to have a horizontal cross-sectional area decreasing gradually as it extends downwardly, the space between opposite chamber walls 120 defining the chamber 110 is uncertain to decrease gradually as the chamber 110 extends downwardly. In some cases, the space between opposite chamber walls 120 may increase gradually, as the chamber 110 extends downwardly, or may be constant throughout the vertical length of the chamber 110 or over a certain vertical length portion of the chamber in accordance with the cross-sectional shape of the chamber 110.

Where each chamber 110 is structured to have a horizontal cross-sectional area decreasing or increasing gradually, as it extends downwardly, while having a uniform cross-sectional shape throughout the vertical length thereof, each of opposite chamber walls 120 defining the chamber 110 is shaped to have opposite side surfaces having a slope. In this case, each chamber wall 120 has a cross-sectional area varying in inverse proportion to the variation in the cross-sectional area of the chamber 110. However, where the chamber 110 is structured to have a horizontal cross-sectional area decreasing or increasing gradually, as it extends downwardly, while having a non-uniform cross-sectional shape throughout the vertical length thereof, each of opposite chamber walls 120 defining the chamber 110 may be shaped to have various shapes. In this case, each chamber wall 120 has a cross-sectional area which may vary without being inversely proportional to the variation in the cross-sectional area of the chamber 110.

In order to allow the formation of the chambers 110 to be uniformly achieved while being reproducible in either the case in which the chamber formation is carried out in a mechanical fashion or the case in which the chamber formation is carried out in a chemical fashion, each chamber 110 is typically intended to have a uniform cross-sectional shape throughout the vertical length thereof. In this regard, in the case of the present invention, it is most preferable that each chamber has a horizontal cross-sectional area decreasing gradually, as it extends downwardly, while having a uniform cross-sectional shape throughout the vertical length thereof.

In this case, each chamber wall 120, which is offset from the associated chamber 110 in regard to cross-sectional area, is shaped to have a cross-sectional area increasing gradually, as it extends downwardly, in a manner inverse to that in the associated chamber.

Since a separate channel plate or channel plate means, such as a restrictor plate or reservoir plate, and a nozzle plate are bonded to the lower surfaces of the chamber walls 120, the increased cross-sectional area of each chamber wall 120 at its lower end thereof results in an increase in the bonding force between the chamber wall 120 and those plates bonded to the chamber wall 120.

Meanwhile, the ink jetting force of the actuator depends mainly on a bending moment generated when the vibrating plate 200 is bent. Such a bending moment is effectively generated when each chamber 110 has a sufficient operating space.

Figure 7:
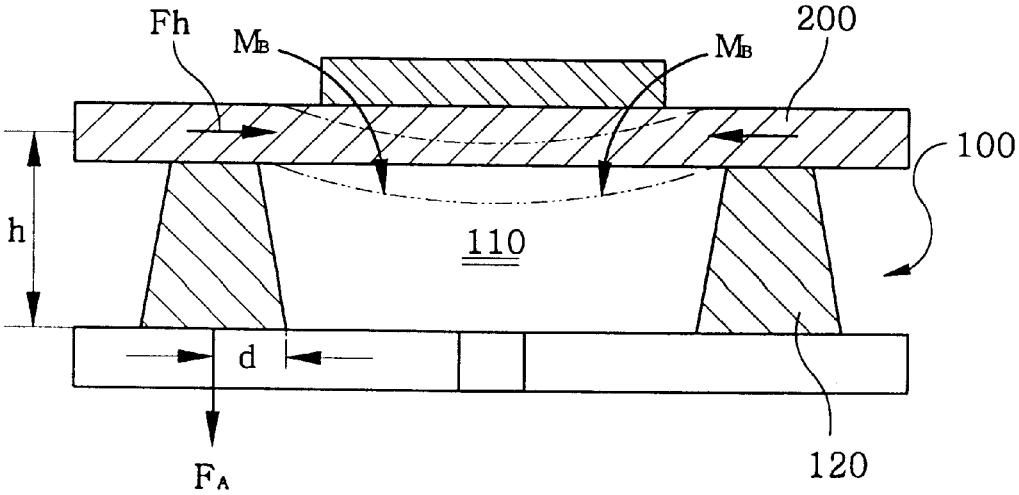

In this regard, where each chamber 110 has a horizontal cross-sectional area $C_U$, at the top thereof, larger than the horizontal cross-sectional area $C_L$ at the bottom thereof, as shown in FIG. 7, an increased bending moment is generated at the vibrating plate 200, thereby obtaining an increased ink jetting force.

When each drive means 300 is strained, a moment is transmitted to the chamber walls 120 associated with the drive means 300 via the vibrating plate 200. Due to such a moment, a structural cross-talk is generated at the chamber walls 120, so that the bonding layer interposed between the chamber walls 120 and the channel plate means bonded to the chamber walls 120 may be damaged.

Thus, the above mentioned moment is a main factor determining the structural strength of the inkjet printer head. In particular, it is not too much to say that the structural strength of the printer head depends mainly on the bonding strength of the chamber plate exhibited at the bottom thereof. This will be described in more detail by referring to FIG. 13.

The bonding strength of the chamber plate 100 depends mainly on a horizontal force Fh generated by the drive means 300 and a bending moment $M_B$ generated by the vibrating plate 200, being bent, when the piezoelectric element included in the drive means 300 is strained and recovered in accordance with its repeated shrinkage and expansion. A moment Mh is generated due to the horizontal force Fh. This moment Mh can be expressed as follows:

$$Mh=Fh\cdot h \qquad \text{[Expression 1]}$$

where, "h" represents a vertical distance from the thickness center of the vibrating plate 200 to the bonding surface of the chamber plate 100.

Accordingly, the total moment generated by the drive means 300 can be expressed as follows:

$$M_{totoal}=M_B+Mh=M_B+Fh\cdot h \qquad \text{[Expression 2]}$$

Meanwhile, a resistance moment $M_R$ generated by the bonding force of the chamber plate 100 can be expressed as follows:

$$M_R=F_A\cdot d \qquad \text{[Expression 3]}$$

where, "$F_A$" represents the bonding force of the chamber plate 100, and "d" represents a horizontal distance from the bonding surface center of the chamber wall 120 to a lateral end of the chamber wall 120 arranged toward the chamber 110.

In order to avoid a structural cross-talk and structural deformation caused by the strain of the drive means 300, the bonding force, namely, the resistance moment $M_R$, should be greater than the total moment $M_{total}$. That is, the following expression should be satisfied.

$$F_A\cdot d>>M_B+Fh\cdot h \qquad \text{[Expression 4]}$$

Where it is desired to obtain a resistance moment $M_R$ greater than the total moment $M_{total}$ under the condition in which the bonding force $F_A$ is constant by virtue of the use of the same bonding method, therefore, it is necessary to increase the bonding area. In accordance with the present invention, such an increase in the bonding area can be achieved by increasing the horizontal distance d extending from the bonding surface center of the chamber wall 120 to a lateral end of the chamber wall 120 arranged toward the chamber 110. By virtue of such an increased bonding surface, a resistance moment $M_R$ greater than the total moment $M_{total}$ is generated, thereby keeping a stable operating structure.

Accordingly, the present invention implements a structure in which each chamber 110 has a horizontal cross-sectional area decreasing gradually as it extends downwardly in such a fashion that it has a maximum horizontal cross-sectional area $C_U$ at the upper end thereof, namely, the top thereof, while having a minimum horizontal cross-sectional area $C_L$ at the lower end thereof, namely, the bottom thereof, in order to maximize the bending moment generated at the vibrating plate 200, thereby enhancing the ink jetting efficiency. Also, the present invention implements a structure in which each chamber wall 120 has a horizontal cross-sectional area increasing gradually as it extends downwardly in such a fashion that it has a minimum horizontal cross-sectional area $CW_U$ at the upper end thereof while having a maximum cross-sectional area $CW_L$ at the lower end thereof, thereby increasing the bonding strength of the chamber wall 120 and, thus, the resistance moment MR against the bending moment of the vibrating plate 200, thereby achieving an improvement in durability.

Now, a procedure for fabricating an inkjet printer head actuator having the above mentioned structure according to the present invention will be described.

FIGS. 8 to 13 illustrate a first embodiment of the present invention associated with a method for fabricating an inkjet printer head actuator having the above mentioned structure according to the present invention, respectively.

Figure 8:
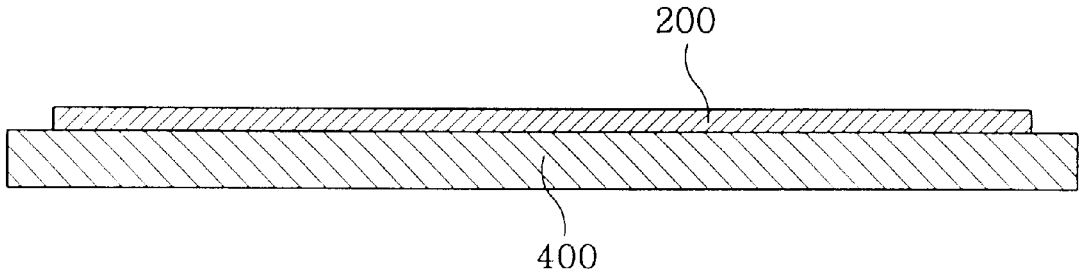

In accordance with this embodiment, a separate substrate 400 is first prepared, as shown in FIG. 8. A vibrating plate 200 made of metal is then formed over the substrate 400. The formation of the vibrating plate 200 is achieved using a vacuum deposition process such as electro-forming, sputtering, or evaporation.

Alternatively, the vibrating plate 200 may be separately prepared. In this case, the vibrating plate 200 is formed by rolling a separate substrate into a thin plate in accordance with a pressing process, and then bonding the thin plate to the substrate 400.

The vibrating plate 200 preferably has a thickness of about 10 $\mu$m to about 20 $\mu$m. The vibrating plate 200 is made of a material containing, as its major component, metal such as nickel or ceramic. Most preferably, the vibrating plate 200 is made of stainless steel as its major component.

Figure 9:
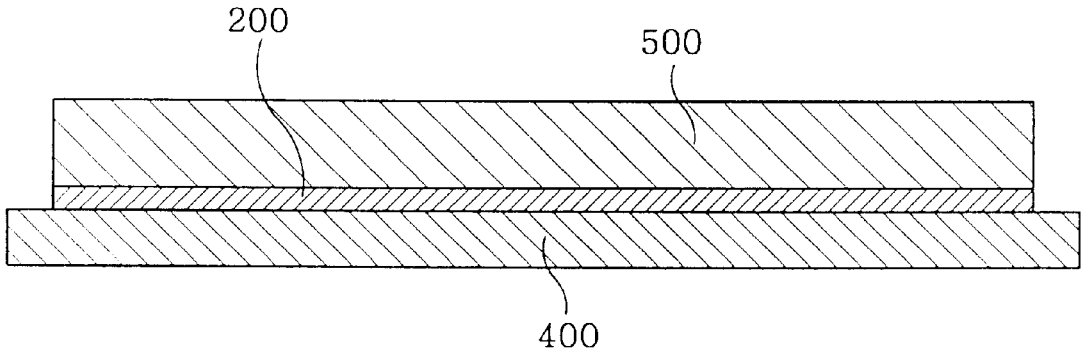

Thereafter, a photoresist film 500 is coated over the vibrating plate 200, as shown in FIG. 9. The photoresist film 500 has a thickness greater than that of a chamber plate to be subsequently formed.

The photoresist film 500 is then subjected to a light exposure and development process using a mask 600 arranged thereon, and then rinsed using a rinsing solution, so that it is patterned in order to remove its unnecessary portion.

In this case, the photoresist film 500 is preferably made of a positive photoresist. However, the photoresist film 500 is not limited to the positive photoresist.

Upon the patterning, the photoresist film 50 is exposed to light in such a fashion that it has a maximum light-exposed area at the upper surface thereof while having a light-exposed area decreasing gradually as it extends to the lower surface thereof, by virtue of an intensity effect of light decreasing gradually in the thickness direction of the photoresist film 50. As a result, the photoresist film 500 is left, after the patterning, while having a shape of FIG. 10 in which it has a maximum cross-sectional area at the upper surface thereof while having a cross-sectional area decreasing gradually as it extends to the lower surface thereof.

Figure 10:
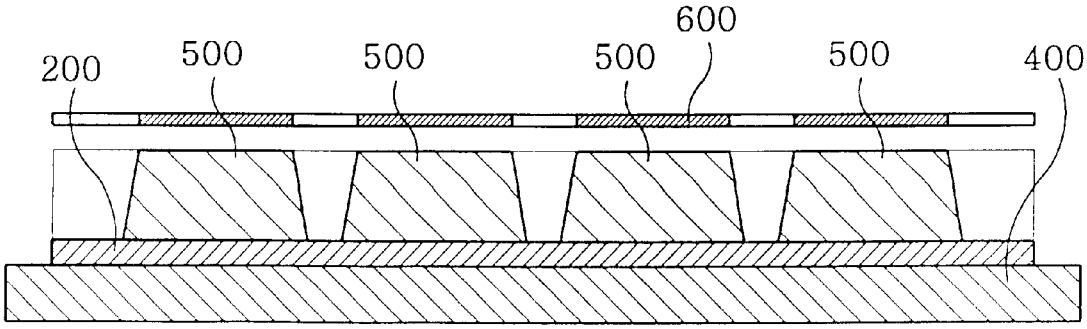
Figure 11:
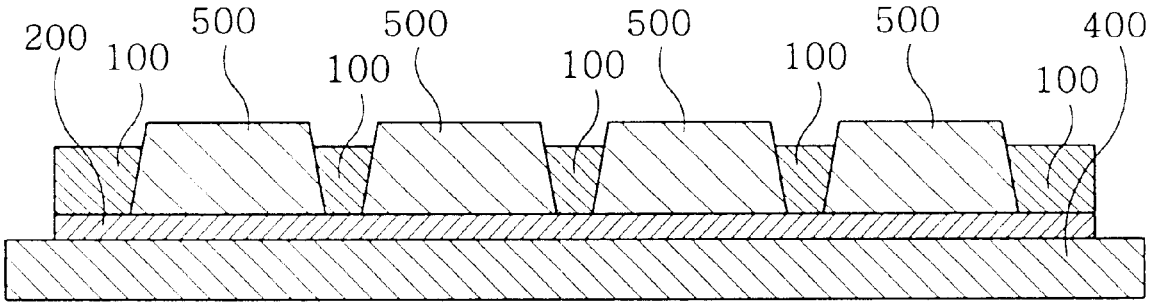

In the resulting structure, the photoresist film 500 partially removed in accordance with the patterning is left on the vibrating plate 200 while defining trenches corresponding to the removed photoresist film portions, respectively. Subsequently, a chamber plate 100 is deposited to a thickness of 100 $\mu$m to 150 $\mu$m on the above structure in such a fashion that it fills the trenches, in accordance with an electro-forming process, as shown in FIG. 10.

Figure 12:
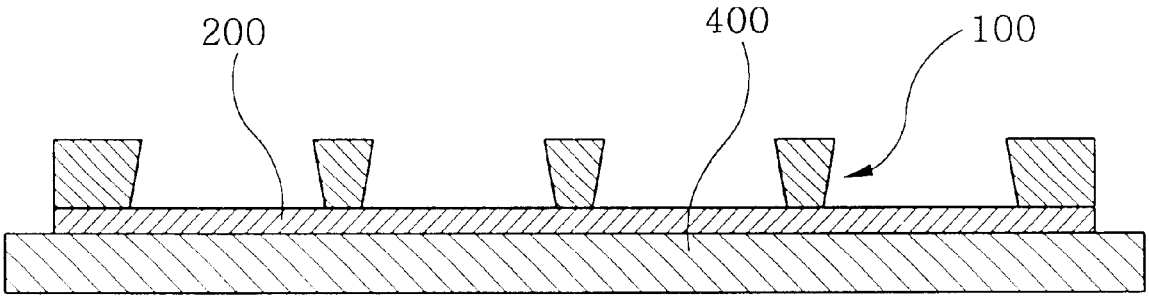

After the deposition of the chamber plate 100, the photoresist film 500 left on the vibrating plate 200 is completely removed using a rinsing solution, as shown in FIG. 12. Thus, the chamber plate 100 is defined with chambers 110 each having a shape in which its horizontal cross-sectional area decreases gradually as it extends vertically from one end thereof arranged toward the vibrating plate 200 to the other end thereof arranged away from the vibrating plate 200.

Thereafter, the substrate 400, which supports the vibrating plate 200, is removed. Thus, a structure is obtained in which each chamber 110 has a horizontal cross-sectional area decreasing gradually, as it extends vertically from one end thereof arranged toward the vibrating plate 200 to the other end thereof arranged away from the vibrating plate 200, whereas each of the chamber walls 120 defining the chamber 110 has a horizontal cross-sectional area increasing gradually as it extends vertically from one end thereof arranged toward the vibrating plate 200 to the other end thereof arranged away from the vibrating plate 200.

When viewed in the front side, the chamber walls 120 of the chamber plate 100 have a trapezoidal shape having a cross-sectional area increasing gradually, as it extends from the top thereof to the bottom thereof, whereas the chambers 110 of the chamber plate 100 have an inverted trapezoidal shape having a cross-sectional area decreasing gradually, as it extends from the top thereof to the bottom thereof.

A drive means 300, which consists of a piezoelectric element and an electrode laminated together, is then attached to a surface of the vibrating plate 200 opposite to the chamber plate 100 at a region corresponding to an associated one of the chambers 110. Thus, an inkjet printer head actuator having the structure shown in FIG. 5 is obtained.

Subsequently, a channel plate, restrictor plate, or reservoir plate is bonded to a surface of the chamber plate 100 opposite to the vibrating plate 200, that is, the lower surface of the chamber plate 100 having a maximum horizontal cross-sectional area. Finally, a nozzle plate is bonded to the channel plate, restrictor plate, or reservoir plate. Thus, an inkjet printer head is obtained.

Figure 13:
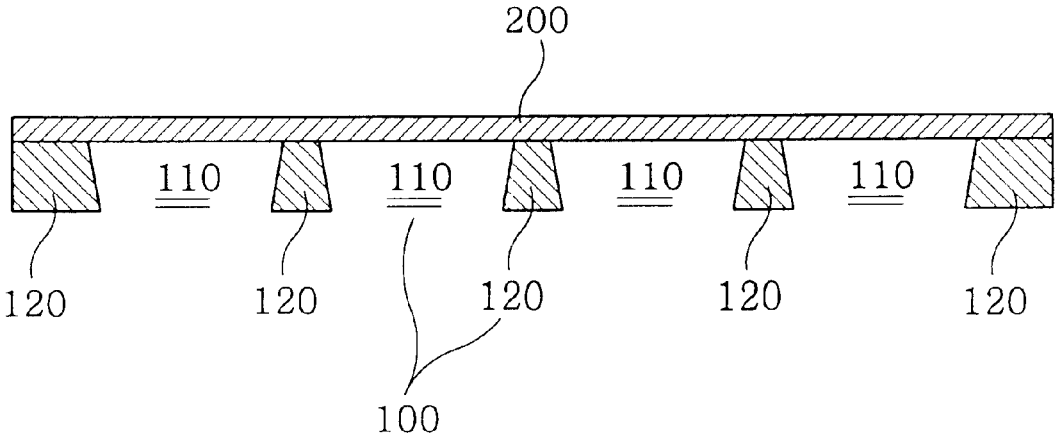
FIG. 13 is an enlarged cross-sectional view illustrating the relationship between bending strain and bending moment generated at the printer head structure fabricated in accordance with the present invention.

In the actuator fabricated in the above mentioned manner, a maximized bending moment is generated when the drive means 300 is activated by electric power externally applied thereto, thereby bending the vibrating plate 200, as shown in FIG. 13. This is because each chamber 110 of the chamber plate 100 has a maximum horizontal cross-sectional area $C_U$ at its end arranged toward the vibrating plate 200.

On the other hand, FIGS. 14 to 18 illustrate a second embodiment of the present invention associated with a method for fabricating an inkjet printer head actuator having the above mentioned structure according to the present invention, respectively. In FIGS. 14 to 18, elements respectively corresponding to those in FIGS. 8 to 13 will be denoted by the same reference numerals.

Figure 14:
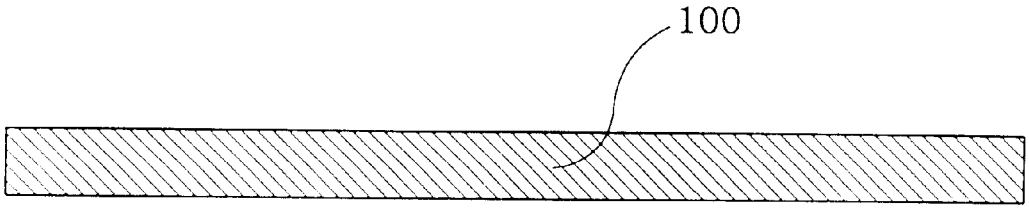

In accordance with this embodiment, a separate chamber plate 100 is first prepared, as shown in FIG. 14. The chamber plate 100 has a thickness of 100 $\mu$m to 150 $\mu$m and is made of the same metal as that in the first embodiment.

Figure 15:
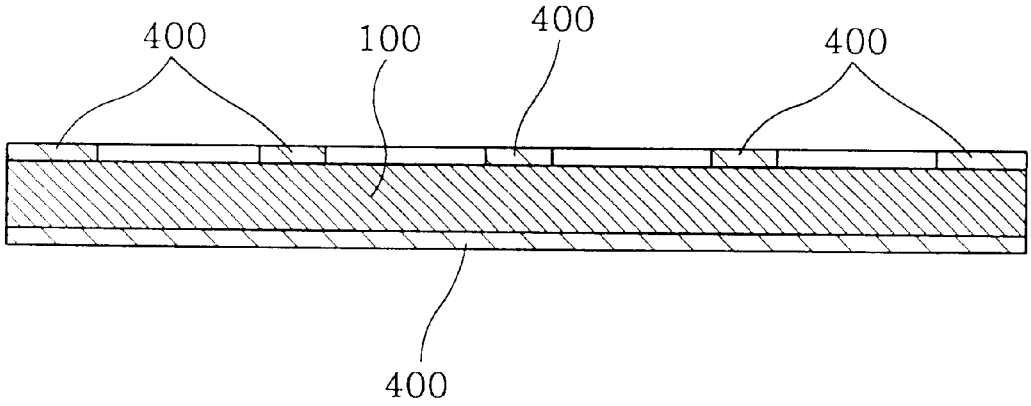
Figure 16:
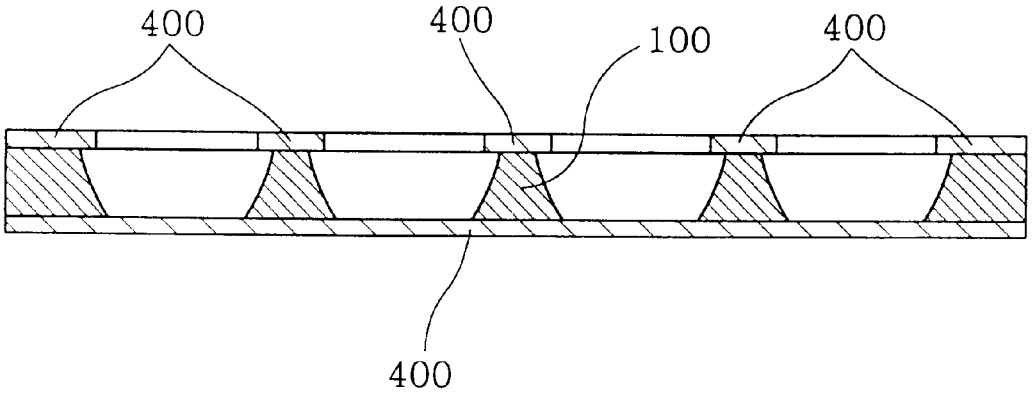

Thereafter, a pair of photoresist films 500 are coated to a desired thickness over the upper and lower surfaces of the vibrating plate 200, respectively, as shown in FIG. 15. One of the photoresist films 500 is then subjected to a light exposure and development process using a mask 600 arranged thereon, and then rinsed using a rinsing solution, so that it is patterned in order to remove its unnecessary portion.

Using the patterned photoresist film 500 as a mask, an etching process is carried out for the chamber plate 100 using an etchant solution so that the exposed portions of the chamber plate 100 not covered with the patterned photoresist film 500 are completely etched. As a result, the chamber plate 100 has an etched pattern having a cross-sectional area decreasing gradually as it extends downwardly from its upper surface, to which the etchant solution was initially applied, to its lower surface.

The etching process may be achieved in a wet etching fashion in which the chamber plate 100 coated with the photoresist films 500 is etched in a state dipped in an etchant solution. A more common method is to spray an etchant solution onto the surface of the chamber plate 100 toward the patterned photoresist film 500, thereby etching the exposed portions of the chamber plate 100 not covered with the patterned photoresist film 500. In accordance with the present invention, it is preferable to use the latter method.

Figure 17:
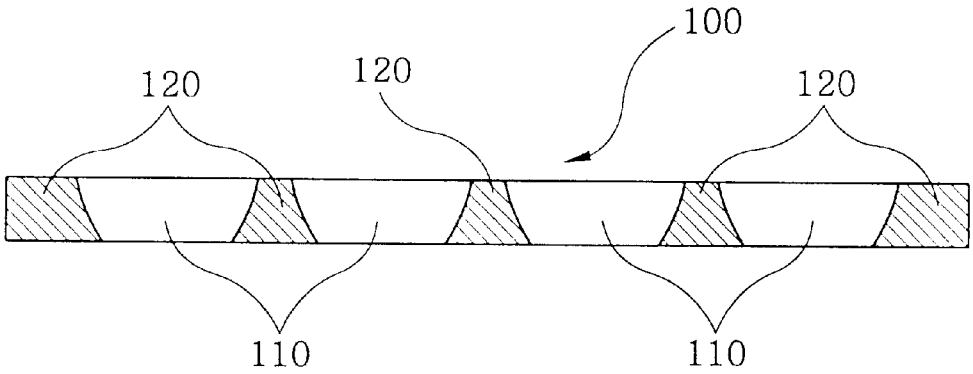

After the pattering of the chamber plate 100 using the etching process, the photoresist films 500 left on the chamber plate 100 are completely removed using a rinsing solution, as shown in FIG. 17. Thus, the chamber plate 100 is defined with chambers 110 each having a shape in which its horizontal cross-sectional area decreases gradually as it extends from the top thereof to the bottom thereof. That is, the chamber plate 100 has chamber walls 120 defining the chambers 100 and having a shape in which its horizontal cross-sectional area increases gradually as it extends from the upper end thereof to the lower end thereof.

Figure 18:
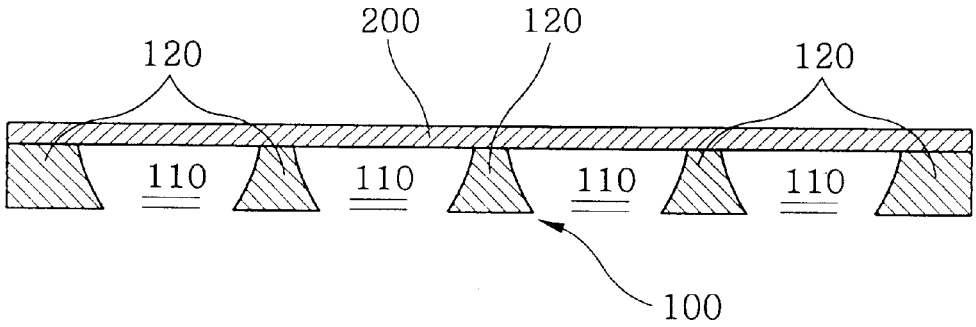

A vibrating plate 200 having a thickness of about 10 $\mu$m to about 20 $\mu$m is then bonded to the surface of the chamber plate 100 having a maximum horizontal cross-sectional area, as shown in FIG. 18. Where the vibrating plate 200 is made of the same material as the chamber plate 100, the boding of the vibrating plate 200 is achieved using a brazing process so that the vibrating plate 200 is integral with the chamber plate 100.

Since the vibrating plate 200 has a thin structure having a thickness of about 10 $\mu$m to about 20 $\mu$m, it is difficult for the vibrating plate 200 itself to be handled.

Figure 19:
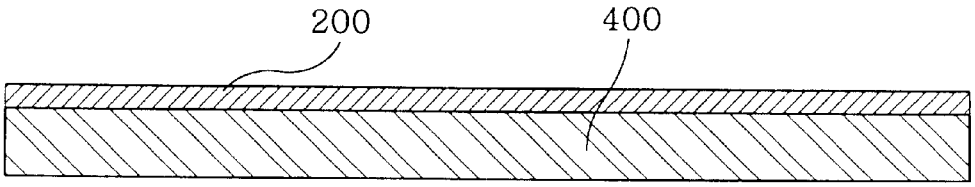
Figure 20:
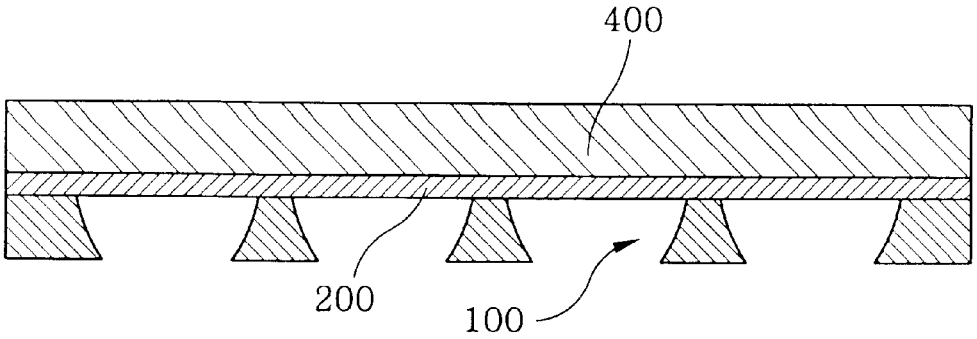
Figure 21:
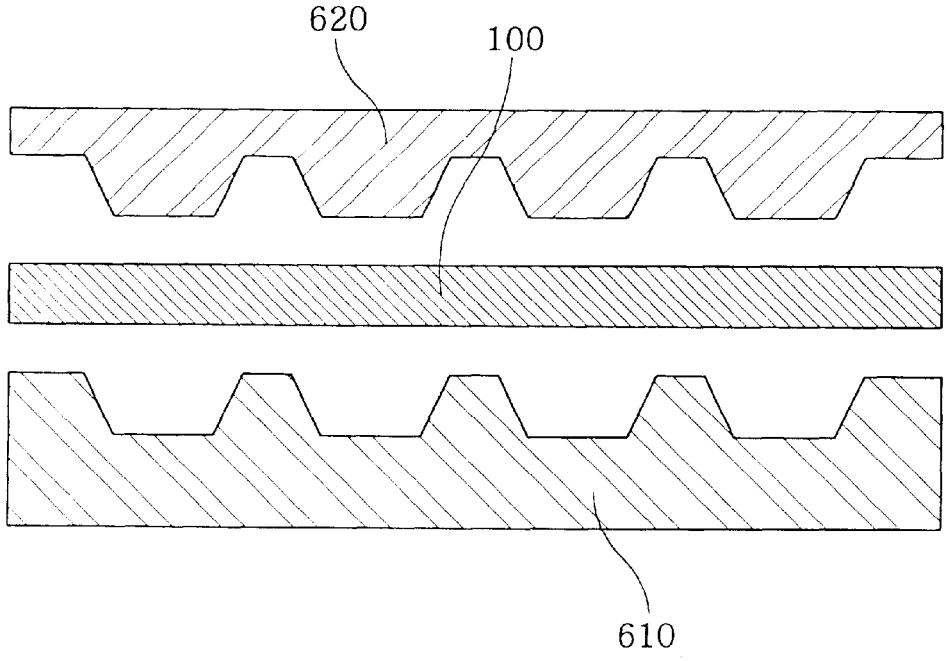

To this end, a separate substrate 400 is prepared. The vibrating plate 200 is formed to a desired thickness over the substrate 400 in accordance with an electro-forming process, as shown in FIG. 19. The vibrating plate 200 is then bonded to the chamber plate 100 in a state supported by the substrate 400, as shown in FIG. 20. After the bonding of the vibrating plate 200, the substrate 400 is separated from the vibrating plate 200. This method is most preferable.

In the state in which the chamber plate 100 and vibrating plate 200 are coupled together as mentioned above, a drive means 300, which consists of a piezoelectric element and an electrode coupled together, is then attached to a surface of the vibrating plate 200 opposite to the chamber plate 100 at a region corresponding to an associated one of the chambers 110. Thus, an inkjet printer head actuator is obtained.

On the other hand, FIGS. 21 to 24 illustrate a third embodiment of the present invention associated with a method for fabricating an inkjet printer head actuator having the above mentioned structure according to the present invention, respectively. This embodiment is characterized in that the formation of the chambers 110 at the chamber plate 100 is carried out in accordance with a punching process using a press shown in FIG. 21. In FIGS. 21 to 24, elements respectively corresponding to those in FIGS. 8 to 13 will be denoted by the same reference numerals.

In accordance with this embodiment, the press includes a fixed die 610 and a punch 620 facing each other. The fixed die 610 has, at a surface facing the punch 620, grooves having the same shape as that of chambers to be formed. The punch 620 has, at a surface facing the fixed die 610, protrusions corresponding to the grooves of the fixed die 610, respectively. Each groove of the fixed die 610 and each protrusion of the punch 620 are shaped in such a fashion that they have a horizontal cross-sectional area increasing or decreasing gradually, as they extend vertically, so as to have side surfaces having a slope.

Figure 22:
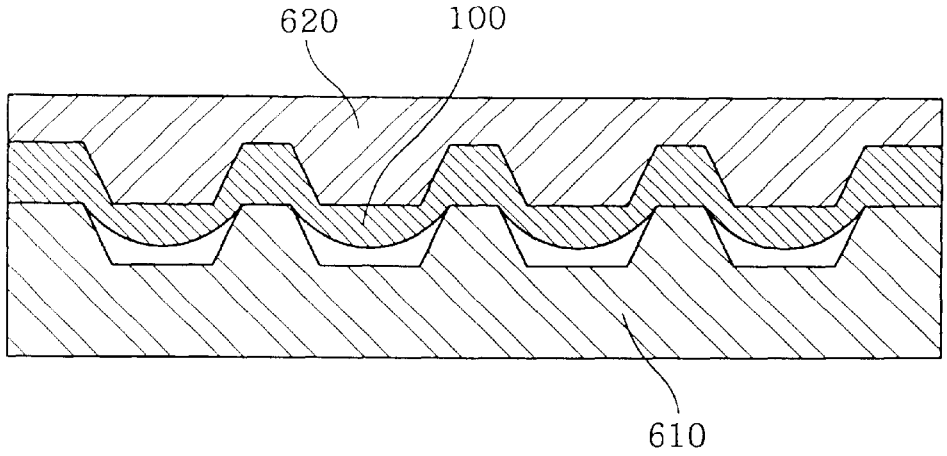
Figure 23:
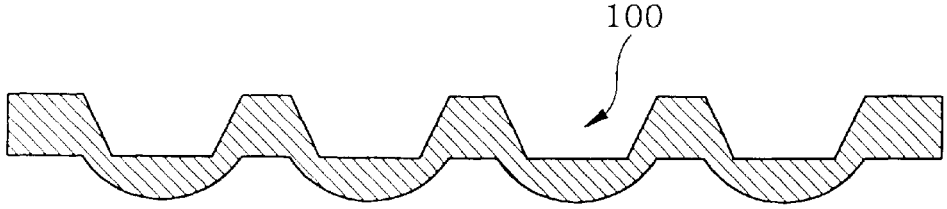

The chamber plate 100 having chambers is formed by interposing a flat plate, previously prepared to have a thickness of about 100 $\mu$m to about 150 $\mu$m, between the fixed die 610 and the punch 620, conducting a punching process for the flat plate while downwardly moving the punch 620 toward the fixed die 610, as shown in FIG. 22. After the completion of the punching process, grooves, which have a horizontal cross-sectional area increasing gradually as it extends downwardly, are formed at the chamber plate 100, as shown in FIG. 23. In this case, round protrusions are downwardly protruded from the lower surface of the chamber plate 100 beneath the grooves, respectively.

Figure 24:
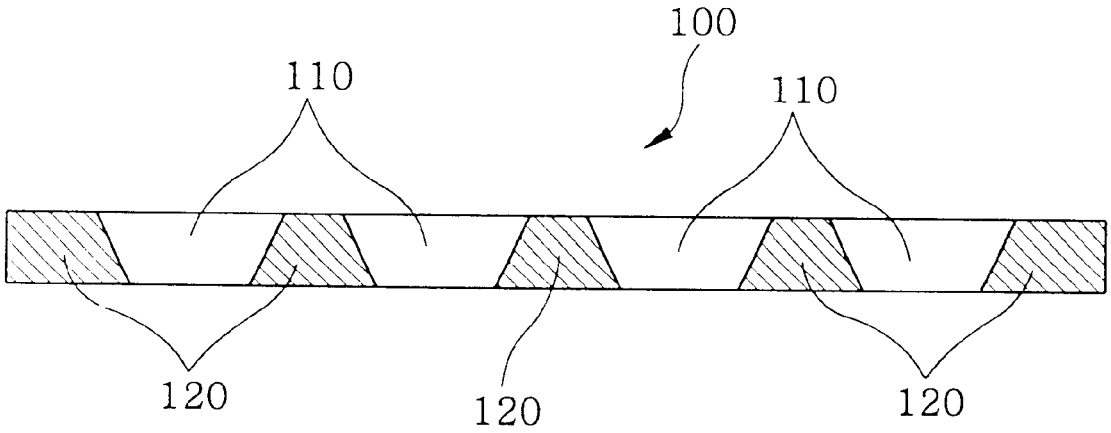
Figure 25:
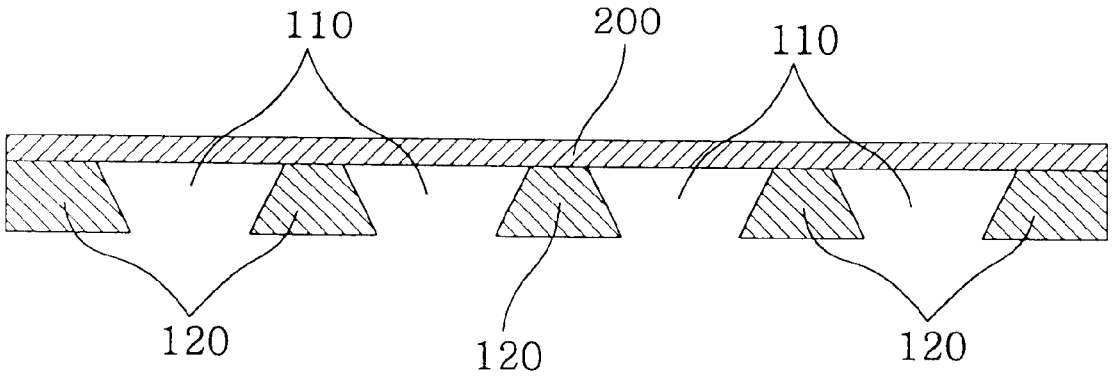

The round protrusions are subsequently removed using a grinding process. Thus, the chamber plate 100, which has trapezoidal chambers 110 as shown in FIG. 24, is completely fabricated. A vibrating plate 200 separately prepared is then bonded to the upper surface of the chamber plate 100 having a maximum open cross-sectional area, in the same manner as in the second embodiment.

Thereafter, a drive means 300, which consists of a piezoelectric element and an electrode coupled together, is then attached to a surface of the vibrating plate 200 opposite to the chamber plate 100 at a region corresponding to an associated one of the chambers 110. Thus, an inkjet printer head actuator is obtained in which the chambers 110 and chamber walls 120 have desired shapes, respectively. Subsequently, a channel plate, restrictor plate, or reservoir plate is bonded to a surface of the chamber plate 100 opposite to the vibrating plate 200, that is, the lower surface of the chamber plate 100. Finally, a nozzle plate is bonded to the channel plate, restrictor plate, or reservoir plate. Thus, an inkjet printer head is obtained.

As apparent from the above description, the present invention provides an inkjet printer head actuator in which the shape of ink chambers directly effecting the ink jetting efficiency of the actuator is offset to the shape of chamber walls defining those ink chambers. In accordance with the present invention, each ink chamber has a shape capable of maximizing the bending strain of a vibrating plate, thereby achieving an improvement in the ink jetting efficiency. On the other hand, each chamber wall has a shape capable of providing an increased bonding force to a structure for providing ink channels. Thus, the inkjet printer head actuator of the present invention has advantages capable of keeping a stable operation while achieving an improvement in durability.

In particular, the improved ink jetting efficiency results in an improvement in the printing quality. Meanwhile, the increased bonding strength results in a lengthened use life span of the actuator. In accordance with the present invention, therefore, it is possible to provide an inkjet printer which is advantageous in regard to performance and costs.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A method for fabricating an inkjet printer head actuator, comprising the steps of:

depositing a vibrating plate to a desired thickness over a substrate;

coating a photoresist film to a desired thickness over said vibrating plate;

patterning said photoresist film in accordance with a light exposure, development, and rinsing process, thereby removing unnecessary portions of said photoresist film while leaving photoresist film patterns uniformly spaced from one another and shaped in such a fashion that each of said photoresist film patterns has a horizontal cross-sectional area increasing as it extends downwardly toward said vibrating plate;

depositing a chamber plate on said vibrating plate partially exposed among said photoresist film patterns to a thickness not more than said thickness of said photoresist film;

completely removing said photoresist film patterns, separating said vibrating plate and said chamber plate containing chambers, coupled together, from said substrate; and depositing a plurality of drive means, each comprising a piezo-electric element and an electrode coupled to said piezoelectric element, on a surface of said chamber plate opposite to said vibrating plate as regions corresponding to said chambers, respectively.

2. The method as claimed in claim 1, wherein said photoresist film is made of a positive photoresist.

3. The method as claimed in claim 1, wherein said vibrating plate has a thickness of about 10 $\mu$m to 20 $\mu$m.

4. The method as claimed in claim 1, wherein said chamber plate has a thickness of about 100 $\mu$m to 150 $\mu$m.

5. The method as claimed in claim 1, wherein said vibrating plate is deposited by electro-forming.

6. The method as claimed in claim 1, wherein said chamber plate is deposited by electro-forming.

7. A method for fabricating an inkjet printer head actuator, comprising the steps of:

preparing a chamber plate having a desired thickness;

coating a pair of photoresist films to a desired thickness over opposite surfaces of said chamber plate, respectively;

patterning one of said photoresist film in accordance with a light exposure, development, and rinsing process, thereby removing unnecessary portions of said photoresist film while leaving photoresist film patterns uniformly spaced from one another;

applying an etchant solution to said chamber plate surface partially exposed among said photoresist film patterns, thereby etching said chamber plate until said etchant solution reaches the other one of said photoresist films, thereby forming chambers each having a cross-sectional area varying as it extends vertically;

completely removing said photoresist films from said opposite surface of said chamber plate with a rinsing solution;

depositing a vibrating plate to a desired thickness over a substrate;

bonding said vibrating plate, attached to said substrate, to one of said opposite surfaces of said chamber plate where each of said chambers has a maximum cross-sectional area;

separating said substrate from said vibrating plate; and depositing a plurality of drive means, each comprising a piezo-electric element and an electrode coupled to said piezoelectric element, on the other one of said opposite surfaces of said chamber plate opposite to said vibrating plate at regions corresponding to said chambers, respectively.

8. The method as claimed in claim 7, wherein said chamber plate has a thickness of about 100 $\mu$m to 150 $\mu$m.

9. The method as claimed in claim 7, wherein said vibrating plate has a thickness of about 10 $\mu$m to 20 $\mu$m.

10. The method as claimed in claim 7, wherein said chamber plate is comprised of a rolled plate.

11. The method as claimed in claim 7, wherein said vibrating plate is deposited by electro-forming.

12. A method for fabricating an inkjet printer head actuator, comprising the steps of:

preparing a chamber plate having a desired thickness;

inserting said chamber plate into a press in such a fashion that it is interposed between a fixed die and a punch included in said press;

driving said punch to punch said chamber plate, thereby forming chambers each having a cross-sectional area varying as it extends vertically;

removing protrusions from one of opposite surfaces of said chamber plate during said punching by grinding;

depositing a vibrating plate to a desired thickness over a substrate;

bonding said vibrating plate, attached to said substrate, to the other one of said opposite surfaces of said chamber plate where each of said chambers has a maximum cross-sectional area;

separating said substrate from said vibrating plate; and depositing a plurality of drive means, each comprising a piezo-electric element and an electrode coupled to said piezoelectric element, on said one of said opposite surfaces of said chamber plate opposite to said vibrating plate at regions corresponding to said chambers, respectively.

13. The method as claimed in claim 12, wherein said chamber plate has a thickness of about 100 $\mu$m to 150 $\mu$m.

14. The method as claimed in claim 12, wherein said vibrating plate has a thickness of about 10 $\mu$m to 20 $\mu$m.

15. The method as claimed in claim 12, wherein said chamber plate is comprised of a rolled plate.

16. The method as claimed in claim 12, wherein said vibrating plate is deposited using electro-forming.

* * * * *